US008651617B2

(12) United States Patent
Arakane

(10) Patent No.: US 8,651,617 B2
(45) Date of Patent: Feb. 18, 2014

(54) INK-JET RECORDING APPARATUS

(75) Inventor: Satoru Arakane, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 169 days.

(21) Appl. No.: 13/424,059

(22) Filed: Mar. 19, 2012

(65) Prior Publication Data

US 2013/0002740 A1 Jan. 3, 2013

(30) Foreign Application Priority Data

Jun. 29, 2011 (JP) ..... 2011-143683

(51) Int. Cl.
*B41J 2/165* (2006.01)

(52) U.S. Cl.
USPC ..... 347/22; 347/19; 347/29; 347/32

(58) Field of Classification Search
USPC ..... 347/5, 9, 14, 19, 20, 22, 23, 29, 30, 32, 347/34, 37
See application file for complete search history.

(56) References Cited

U.S. PATENT DOCUMENTS 5,774,139 A * 6/1998 Salzer et al. ..... 347/32
6,682,167 B2 * 1/2004 Davis et al. ..... 347/32
7,364,259 B2 * 4/2008 Inoue ..... 347/29

FOREIGN PATENT DOCUMENTS

JP S62-278071 A 12/1987
JP H06-255195 A 9/1994
JP 2007-331272 A 12/2007

* cited by examiner

*Primary Examiner* — Junita D Jackson
(74) *Attorney, Agent, or Firm* — Baker Botts L.L.P.

(57) ABSTRACT

Ink-jet recording apparatus including carriage movable between first and second stationary members, cap movable between first position for covering nozzles of recording head mounted on the carriage and positioned near the first stationary member, and second position spaced from the first position, abutment portion movable by the carriage moving in first direction to move the cap to the first position, and control device for moving the carriage in second direction for abutment onto the second stationary member, setting this position of abutment as provisional point of origin of the carriage, moving the carriage in the first direction for abutment of the carriage onto the abutment portion at a speed lower than a speed of movement of the carriage before the abutment, further moving the carriage for abutment onto the first stationary member, and setting this position of abutment as point of origin of the carriage.

9 Claims, 10 Drawing Sheets

INK-JET RECORDING APPARATUS

CROSS REFERENCE TO RELATED APPLICATION

The present application claims the priority from Japanese Patent Application No. 2011-143683 filed Jun. 29, 2011, the disclosure of which is herein incorporated by reference in its entirety.

BACKGROUND OF THE DISCLOSURE

1. Field of the Disclosure

The present invention relates generally to an ink-jet recording apparatus having a recording head configured to eject droplets of an ink from its nozzles onto a recording medium for forming an image on the recording medium, and more particularly, to such an ink-jet recording apparatus which is provided with a cap for covering the nozzles of the recording head and wherein the cap is movable between a first position at the cap covers the nozzles and a second position at which the cap is spaced apart from the nozzles.

2. Description of Related Art

There is known an ink-jet recording apparatus having a recording head configured to eject droplets of an ink for forming an image on a recording medium, on the basis of input signals. The ink-jet recording apparatus has a carriage on which the recording head is mounted and which is disposed in opposition to the recording medium and moved in a horizontal direction. During the movement of the carriage, the ink droplets are ejected from selected ones of nozzles of the recording head, to form the desired image on the recording medium.

For ejecting the ink droplets accurately at target spots on the recording medium, the spots at which the ink droplets are deposited must be defined with respect to a predetermined reference point. To this end, the ink-jet recording apparatus is arranged to detect a point of origin of the carriage carrying the recording head, upon power application to the apparatus.

The ink-jet recording apparatus may be of a serial type wherein upon initialization of the apparatus, the carriage held stationary at a certain position after each recording operation is moved toward a stopper for abutment of the carriage onto the stopper, and a position at which the carriage abuts on the stopper is determined as the point of origin of the carriage. Thus, an operation to set the point of origin of the carriage is performed.

Most of an ink-jet recording apparatus have a cap vertically movable between a first position at which the cap covers the nozzles and a second position at which the cap is spaced apart from the nozzles. The ink-jet recording apparatus has a pump which is operated to generate a suction pressure within the cap covering the nozzles, so that air bubbles and foreign matters are removed from the nozzles.

One type of a mechanism used to vertically move the cap utilizes a movement of the carriage. In the mechanism of this type, a cap holder which holds the cap has an abutment portion onto which the carriage moving in the horizontal direction is abuttable. The cap holder is horizontally moved as a result of a movement of its abutment portion by the carriage. The cap holder is supported by a support portion having a slant surface, so that the horizontal movement of the cap holder on the slant surface causes an upward movement of the cap holder, and a consequent upward movement of the cap held by the cap holder, to the position at which the cap covers the nozzles of the recording head mounted on the carriage.

SUMMARY OF THE DISCLOSURE

The ink-jet recording apparatus provided with the mechanism constructed as described above has the following drawback when an operation to set the point of origin of the carriage is performed.

In the process of movement of the carriage toward the stopper upon initialization of the apparatus from the certain position at which the carriage is held stationary after each recording operation, the carriage may come into abutment onto the above-described abutment portion of the cap holder holding the cap, giving rise to a risk of am upward movement of the cap holder, namely, a risk of generation of a force acting on the cap holder in the upward direction, which force is transmitted to the carriage through the abutment portion, and to the nozzles of the recording head mounted on the carriage. In this respect, it is noted that the carriage is moved at a comparatively high speed upon initialization of the ink-jet recording apparatus, to efficiently perform the operation to set the point of origin of the carriage. This high speed of movement of the carriage causes a comparatively large force acting on the nozzles in the upward direction, giving rise to destruction of menisci formed at the nozzles.

The present invention was made in view of the background art described above. It is therefore an object of the present invention to provide an ink-jet recording apparatus which is constructed to prevent destruction of menisci at the nozzles, while minimizing a time required for setting the point of origin of the carriage.

The object indicated above can be achieved according to the principle of this invention, which provides an ink-jet recording apparatus comprising: a recording head having nozzles through which droplets of an ink are ejected; a drive power source; a carriage on which the recording head is mounted and which is slidably movable by the drive power source in opposite first and second directions; a first stationary member onto which the carriage is abuttable during its movement in the first direction; a second stationary member onto which the carriage is abuttable during its movement in the second direction; a detecting portion configured to detect a position of the carriage; a cap which is disposed nearer to the first stationary member than to the second stationary member and which is movable between a first position at which the cap is held in abutting contact with the recording head and covers the nozzles, and a second position at which the cap is spaced apart from the recording head; a displacing mechanism having an abutment portion onto which the carriage is abuttable in the first direction, and configured to move the cap from the second position to the first position by a pushing force generated when the abutment portion comes into abutting contact with the carriage; a first control portion configured to control the drive power source for moving the carriage in the second direction at a first speed by a distance sufficient for abutment of the carriage onto the second stationary member; a first setting portion configured to set a position of abutment of the carriage on the second stationary member as a provisional point of origin of the carriage, when the position of abutment of the carriage on the second stationary member is detected by the detecting portion; a second control portion configured to control the drive power source for moving the carriage which has been moved under the control of the second control portion, in the first direction at a second speed by at least a portion of a distance between the provisional point of origin and a third position which is determined by the provisional point of origin and at which the carriage comes into abutment onto the abutment portion, and for further moving the carriage in the first direction at a third speed lower than the second speed, so that the carriage comes into abutment onto the abutment portion at the third speed at the third position, the second control portion being further configured to control the drive power source for further moving the carriage from the third position in the first direction for abutment of the carriage onto the first stationary member; and a second setting portion configured to set a position of abutment of the carriage on the first stationary member as a point of origin of the carriage when the position of abutment of the carriage on the first stationary member is detected by the detecting portion as a result of the movement of the carriage in the first direction under the control of the second control portion.

BRIEF DESCRIPTION OF THE DRAWINGS

The above and other objects, features, advantages and technical and industrial significance of the present invention will be better understood by reading the following detailed description of preferred embodiments of the present invention, when considered in connection with the accompanying drawings, in which.

DETAILED DESCRIPTION OF EMBODIMENTS

Figure 1:
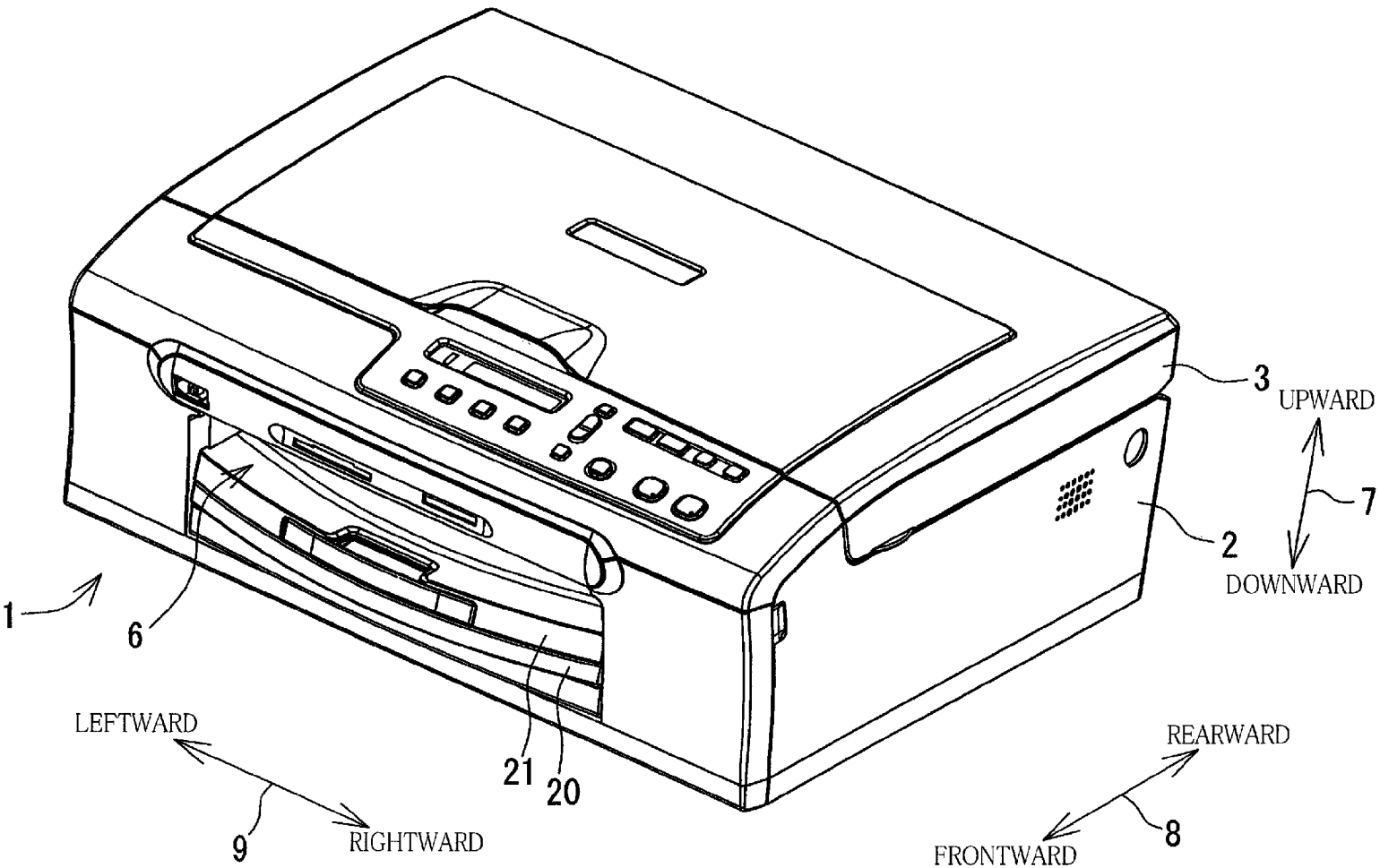
FIG. 1 is a perspective view showing an appearance of a multi-function apparatus 1 constructed according to one embodiment of this invention.

Embodiments of this invention will be described by reference to the accompanying drawings. It is to be understood that the present embodiment will be described for illustrative purpose only, and that the present invention may be otherwise embodied. It is further to be understood that two arrow-headed lines given as vectors in the drawings respectively represent two opposite directions as seen in a vertical direction 7, a sheet feeding direction 8 and a transverse direction 9, and that the vertical direction 7 is defined with respect to an attitude of a multi-function apparatus 1 placed in its operative position of FIG. 1, and the sheet feeding direction 8 is defined as a direction from a front side of the multi-function apparatus 1 (on which an operator's control panel 4 and an opening 6 are provided) toward a rear side opposite to the front side, while the transverse direction 9 is defined as a right-and-left direction when the apparatus 1 is seen in the sheet feeding direction 8.

<Multi-Function Apparatus 1>

As shown in FIG. 1, the multi-function apparatus 1 is a multi-function product or peripheral (MFP) which has a generally rectangular box structure accommodating an ink-jet recording apparatus in the form of a printer portion 2 in its lower part and a scanner portion 3 in its upper part. The multi-function apparatus 1 has a plurality of functions including a printing function, a scanning function, a copying function and a facsimile function, of which only the printing function is essential in an ink-jet recording apparatus according to the present invention. In this respect, therefore, the present invention is applicable to a printer having only the printing function without the provision of the scanner portion 3, for example.

The printer portion 2 is configured to record an image on a recording medium, on the basis of printing data transmitted from an external information processing device such as an external computer. The printer portion 2 has the above-indicated opening 6 on its front side. In the opening 6, a sheet supply tray 20 and a sheet receiver tray 21 are accommodated in a two-stage stack. The scanner portion 3 is of a so-called "flat bed" type. No further description of the scanner portion 3 is deemed necessary for understanding the present invention.

<Sheet Supply Roller 25>

Figure 2:
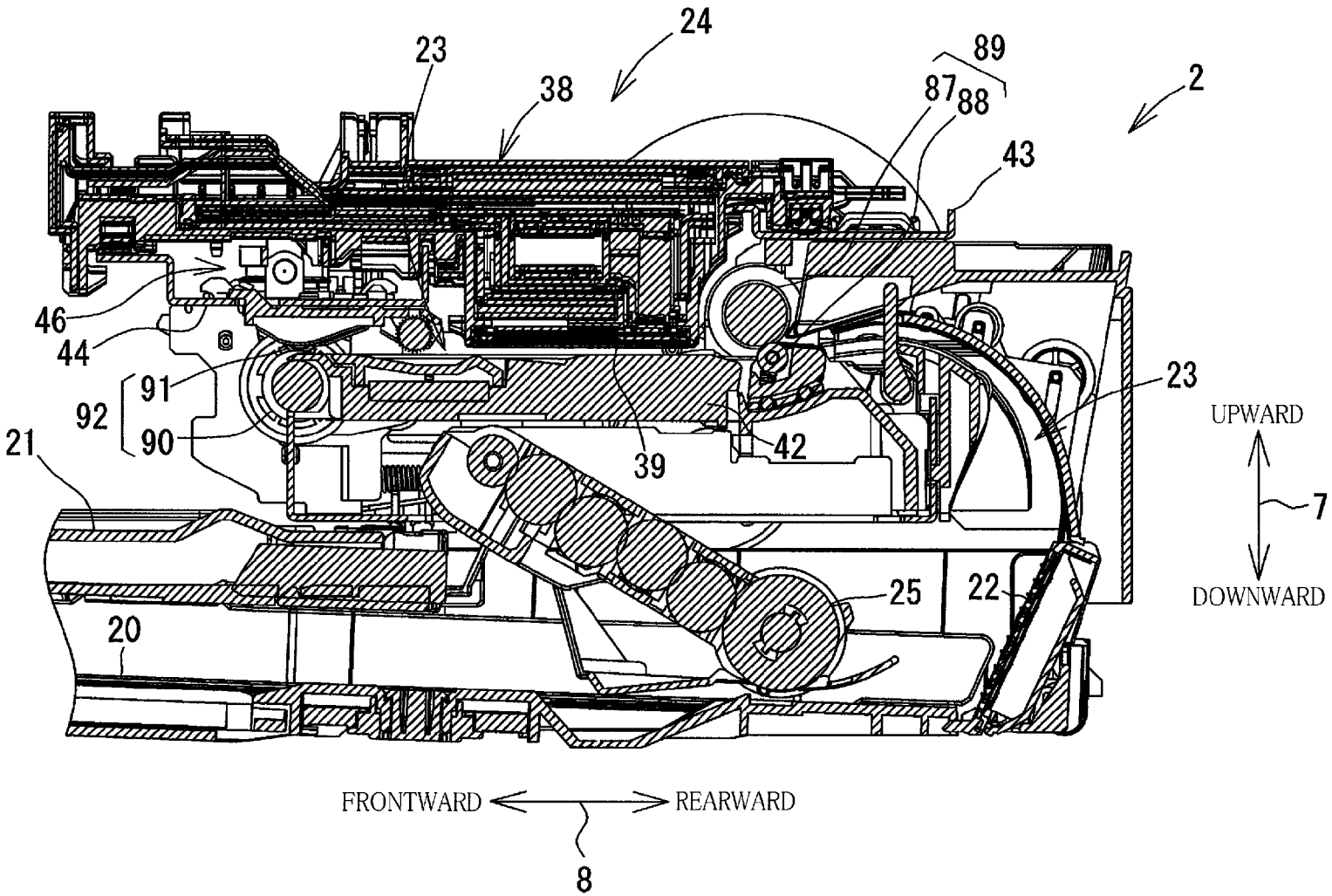
FIG. 2 is an enlarged fragmentary view in cross section showing major components of a printer portion 2 of the multi-function apparatus 1 of FIG. 1.

As shown in FIG. 2, the sheet supply tray 20 is disposed in the lower part of the multi-function apparatus 1. A sheet supply roller 25 is disposed above the sheet supply tray 20. The sheet supply roller 25 is rotated to deliver an uppermost one of paper sheets stacked in the sheet supply tray 20 as the recording medium, such that the delivered paper sheet is fed toward an inclined plate 22.

<Sheet Feeding Path 23>

As also shown in FIG. 2, a sheet feeding path 23 is provided so as to extend from the inclined plate 22, so that the paper sheet horizontally delivered from the sheet supply tray 20 is U-turned upwards along the inclined plate 22 and is guided upwards along the sheet feeding path 23 toward a recording portion 24. After a recording operation to form an image on the paper sheet is performed by the recording portion 24, the paper sheet is further fed onto the sheet receiver tray 21.

<Feed Roller Pair 89 and Ejector Roller Pair 92>

Figure 4:
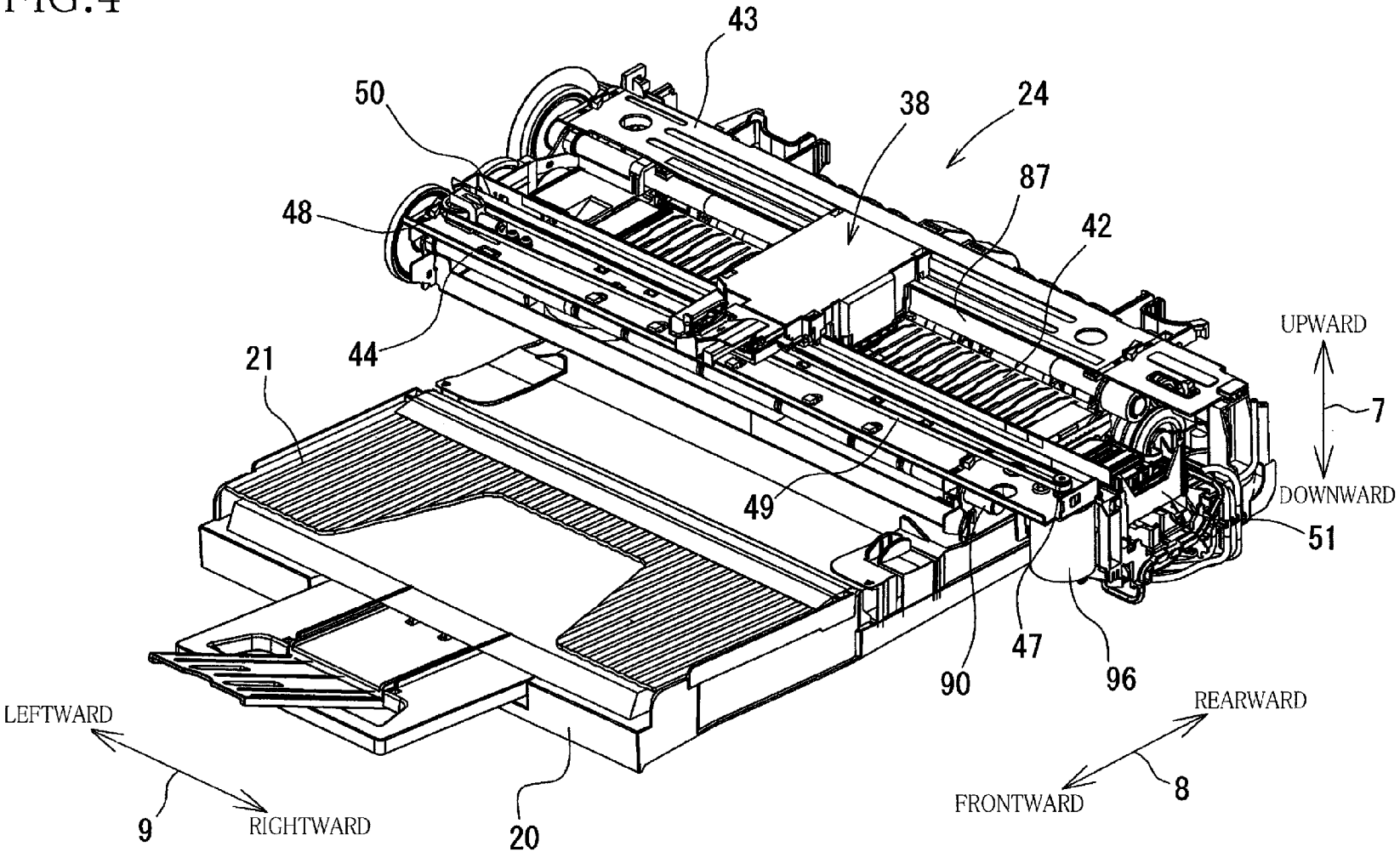
FIG. 4 is a perspective view showing major components of the printer portion 2.

As shown in FIGS. 2 and 4, a feed roller pair 89 consisting of a feed roller 87 ad a pinch roller 88 is disposed upstream of the recording portion 24, while an ejector roller pair 92 consisting of an ejector roller 90 and a spur wheel 91 is disposed downstream of the recording portion 24. The paper sheet which has been fed along the sheet feeding path 23 is further fed onto a platen 42 by the feed roller pair 89. After the image is formed on the paper sheet being supported by the platen 42, the paper sheet is further fed by the ejector roller pair 92 onto the sheet receiver tray 21.

<Recording Portion 24>

As shown in FIG. 2, the recording portion 24 disposed adjacent to the sheet feeding path 23 has a plurality of recording heads 39 of an ink-jet type, and a carriage 38 on which the recording heads 39 are mounted. The carriage 38 is supported slidably in the above-indicated transverse direction 9 (indicated in FIGS. 3 and 4) which is perpendicular to the above-indicated sheet feeding direction 8, namely, slidably in the rightward direction (one of the two opposite directions) and in the leftward direction (the other of the two opposite directions).

The recording heads 39 are mounted on a lower surface of the carriage 38. Each of the recording heads 39 has nozzles 40 (shown in FIG. 4) open in its lower surface and exposed downwards from the carriage 38. The recording heads 39 are supplied with inks of respective different colors from respective ink cartridges (not shown) housed within the multi-function apparatus 1. During sliding movements of the carriage 38, minute droplets of the inks of the different colors are ejected from selected ones of the nozzles 40 of the recording heads 39, to record the desired image on the paper sheet being fed on the platen 42.

Figure 3:
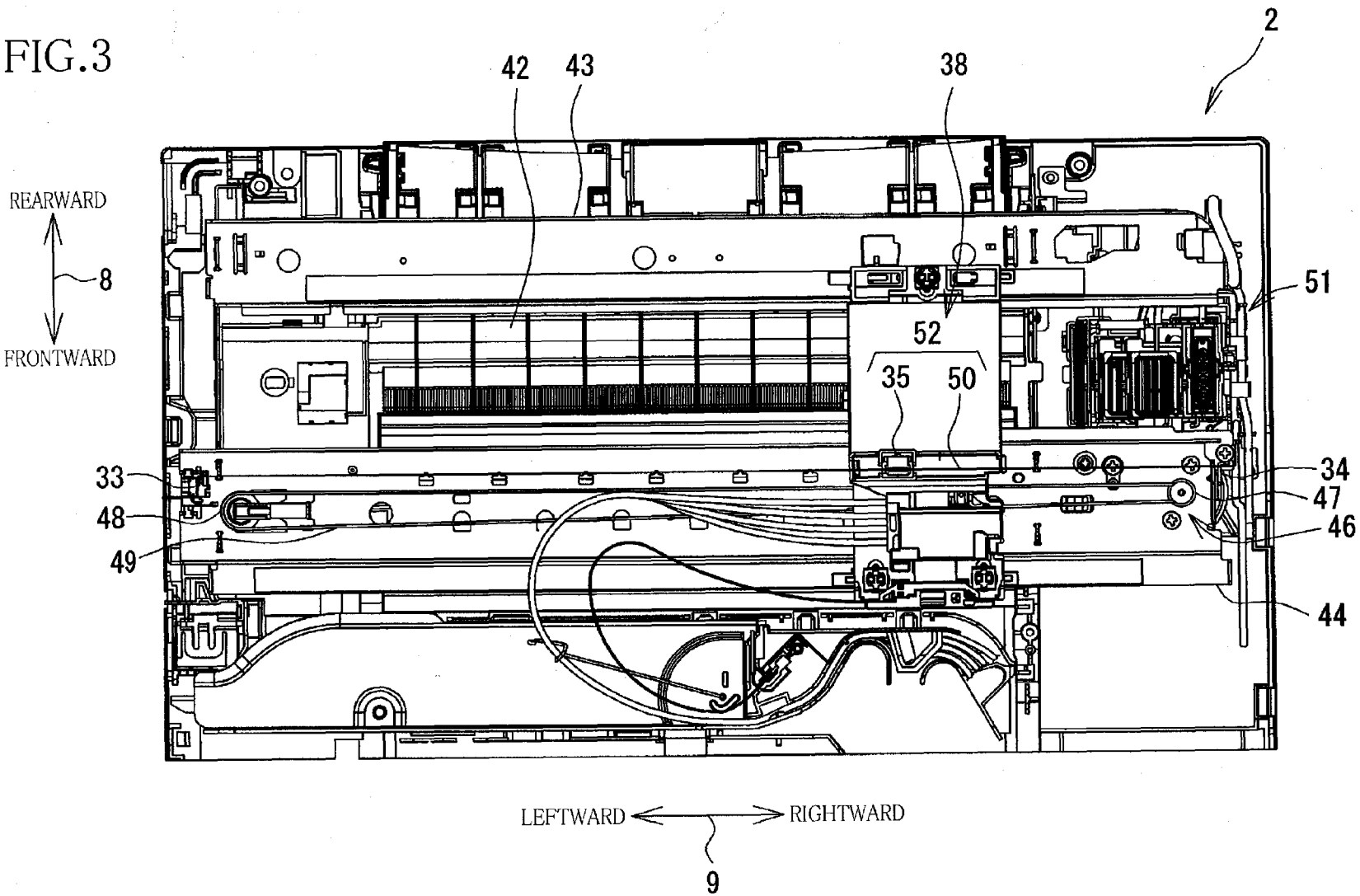
FIG. 3 is a plan view showing major components of the printer portion 2.

As shown in FIGS. 3 and 4, a pair of guide rails 43, 44 are disposed to extend in the transverse direction 9 in a plane above the sheet feeding path 23, such that the guide rails 43, 44 are spaced apart from each other in the sheet feeding direction 8. The guide rails 43, 44 are parts of a frame supporting the components of the printer portion 2. The carriage 38 straddles on the guide rails 43, 44 such that the carriage 38 is slidably movable on the guide rails 43, 44 in the transverse direction 9.

A belt-type transmission mechanism 46 is disposed on the guide rail 44. The transmission mechanism 46 has a driving pulley 47, a driven pulley 48, and an endless belt 49. The driving and driven pulleys 47, 48 are located near respective opposite ends of a horizontal part of the sheet feeding path 23, and are connected to each other by the endless belt 49. A shaft of the driving pulley 47 is connected to a drive shaft of a carriage drive motor 96 (shown in FIG. 4) provided as a drive power source in the printer portion 2, so that the driving pulley 47 is rotated by a rotary motion of the drive shaft of the carriage drive motor 96, to rotate the belt 49. The endless belt 49 may be replaced by a transmission member opposite ends of which are fixed to the carriage 38.

The carriage 38 is fixed on its lower side to the belt 49, so that the carriage 38 is moved in the transverse direction 9 on the guide rails 43, 44, by a rotary motion of the belt 49. Thus, the carriage 38 is slidably moved by a rotary motion of the carriage drive motor 96. The recording heads 39 described above are mounted on the carriage 38, so that the recording heads 39 are reciprocable in a primary scanning direction parallel to the transverse direction 9.

<Linear Encoder 24>

As shown in FIG. 3, an encoder strip 50 is disposed on the guide rail 44. The encoder strip 50 takes the form of a linear band formed of a transparent resin. A pair of ribs 33, 34 are formed so as to extend upwards from the respective opposite end portions (as seen in the transverse direction 9) of the upper surface of the guide rail 44. The encoder strip 50 is held at its opposite ends in engagement with the respective ribs 33, 34, extending in the transverse direction 9.

The encoder strip 50 has a linear detector pattern consisting of light transmitting portions and light shielding portions that are alternately arranged and equally spaced apart from each other in the transverse direction 9 at a predetermined spacing pitch. An optical sensor 35 of a light transmitting type is disposed on a part of the upper surface of the carriage 38, which part is opposed to the encoder strip 50. The encoder strip 50 and the optical sensor 35 cooperate with each other to constitute a detecting portion in the form of a linear encoder 52. An output of the optical sensor 35 is applied to a control device (not shown) described below.

<Maintenance Mechanism 51>

Figure 5A:
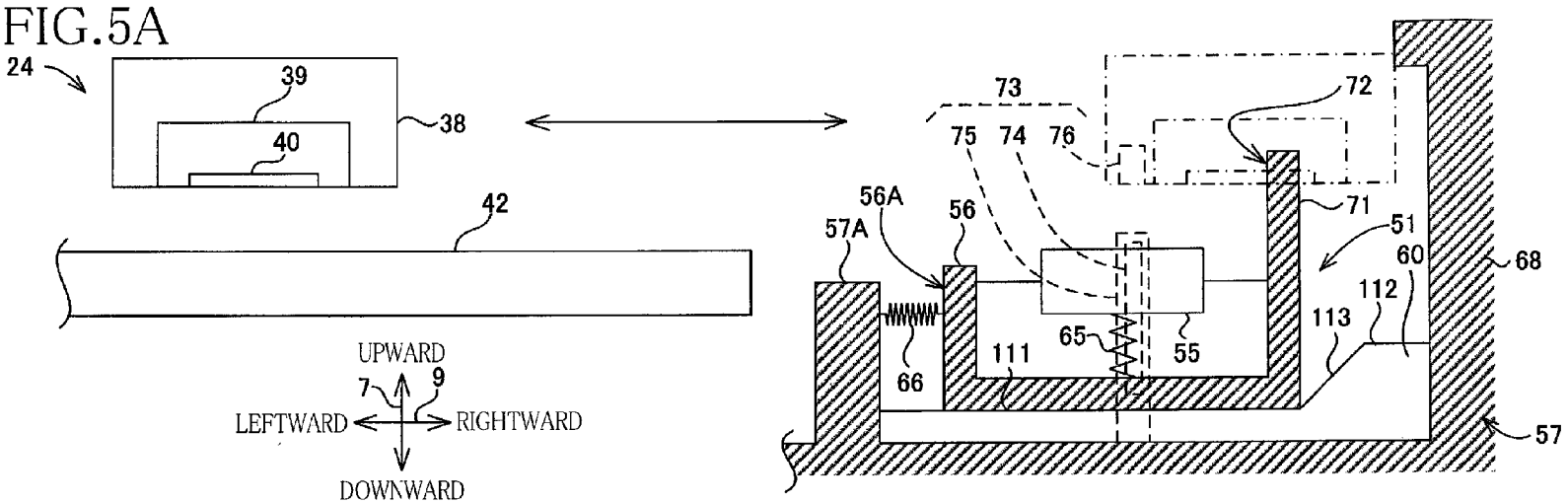
FIGS. 5A and 5B are side elevational views schematically showing a maintenance mechanism 51 of the multi-function apparatus 1 of FIG. 1 when a cap 55 is placed in second and first positions, respectively.
Figure 5B:
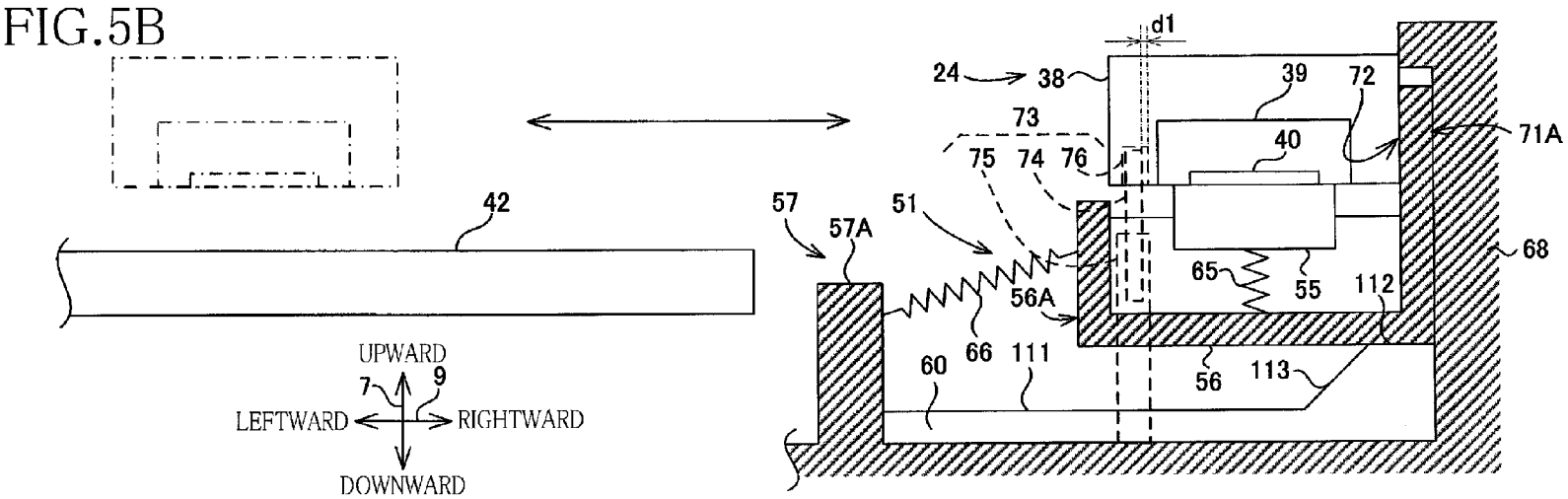

As shown in FIGS. 3-5, a maintenance mechanism 51 is disposed outside an area of the multi-function apparatus 1 in which the paper sheet is fed along the sheet feeding path 23, namely, outside an area of recording of an image by the recording heads 39. Described more specifically, the maintenance mechanism 51 is located on the right side of the platen 42. The maintenance mechanism 51 is configured to prevent drying of the inks in the nozzles 40 of the recording heads 39, and to remove the air bubbles and foreign matters from the nozzles 40 by air suction from the nozzles 40. As shown in FIGS. 5A and 5B, the maintenance mechanism 51 includes, as major components, a cap 55, a first frame 56, a second frame 57, and a slide cam 60. The first frame 56 and the slide cam 60 cooperate to constitute a displacing mechanism for displacing the cap 55 when the carriage 38 is moved toward the maintenance mechanism 51.

The first frame 56 has a box structure, and is supported by the slide cam 60. The slide cam 60 is supported at its bottom by the second frame 57 fixed to the housing of the multi-function apparatus 1.

The slide cam 60 has a guide surface for abutting contact with the lower surface of the first frame 56. The guide surface consists of a horizontally extending first guide surface 111, a horizontally extending second guide surface 112 having a larger height than the first guide surface 111, and a slant surface 113 connecting the first and second guide surfaces 111, 112.

The first frame 56 is slidably movable in the transverse direction 9 while being supported by the first guide surface 111, second guide surface 112 and slant surface 113, such that the first frame 56 is moved in the vertical direction 7 as the first frame 56 is moved on the slant surface 113.

The first frame 56 has a lever 71 extending upright from its bottom wall. The lever 71 extends up to a vertical position at which the carriage 38 is horizontally slidably moved in the transverse direction 9. The lever 71 has an abutment portion 72 onto which the carriage 38 comes into abutment during its horizontal movement in the rightward direction.

The cap 55 is provided to cover the nozzles 40 of the recording heads 39 when the carriage 38 is placed in its capping position (indicated by one-dot chain line in FIG. 5B) in the maintenance mechanism 51. The cap 55 is supported by the bottom wall of the first frame 56. Described more specifically, the cap 55 is elastically supported by a coil spring 65 disposed between its lower surface and the bottom wall of the first frame 56, such that the cap 55 is movable in the vertical direction 7.

<Movement of Cap 55>

When the first frame 56 is supported by the first guide surface 111, as shown in FIG. 5A, the cap 55 supported by the first frame 56 is placed in a second position at which the cap 55 is vertically spaced apart from the recording heads 39. When the first frame 56 is supported by the second guide surface 112, as shown in FIG. 5B, the cap 55 supported by the first frame 56 is placed in a first position at which the cap 55 is held in abutting contact with the lower surfaces of the recording heads 39 and covers the nozzles 40. Thus, the cap 55 is vertically movable between the first and second positions.

A force applying in the form of a coil spring 66 is provided on the left side of the first frame 56, so as to connect a left side surface 56A of the first frame 56 and a projecting portion 57A of the second frame 57. The coil spring 66 has its natural length when the first frame 56 is supported by the first guide surface 111, that is, when the cap 55 is placed in the second position of FIG. 5A. In other words, the coil spring 66 is elongated when the first frame 56 is supported by the second guide surface 112, that is, when the cap 55 is placed in the first position of FIG. 5B. Namely, the cap 55 placed in the first position is elastically forced toward the second position, under a forcing action of the coil spring 66.

After the carriage 38 moving in the rightward direction toward the maintenance mechanism 51 as indicated in FIG. 5A has come into abutment onto the abutment portion 72, the first frame 56 is slidably moved by the carriage 38 in the rightward direction, against the biasing force of the coil spring 66.

As a result, the first frame 56 initially supported by the first guide surface 111 is slid on the slant surface 113, and is eventually supported by the second guide surface 112, as indicated in FIG. 5B. Accordingly, the cap 55 is moved from the second position of FIG. 5A to the first position of FIG. 5B.

<Right Wall 68 and Left Wall 69>

As shown in FIGS. 5A, 5B and 7A-7F, the second frame 57 fixed to the housing of the multi-function apparatus 1 has a first stationary member in the form of a right wall 68 at its right end, and a second stationary member in the form of a left wall 69 at its left end. The right wall 68 is located on the right side of the platen 42, while the left wall 69 is located on the left side of the platen 42. As is apparent from FIGS. 7A-7E, the maintenance mechanism 51 including the cap 55 is located close to the right wall 68.

The carriage 38 is abuttable onto the left wall 69 during its movement in the leftward direction, and onto the right wall 68 during its movement in the rightward direction, as described below in detail. As described above, the nozzles 40 of the recording heads 39 are covered by the cap 55 placed in the first position of FIG. 5A as a result of the movement of the first frame 56 by the carriage 38 held in abutting contact with the abutment portion 72. After the nozzles 40 have been covered by the cap 55, the carriage 38 is further slid on the second guide surface 112 in the rightward direction, by a relatively small distance, more specifically, by a distance corresponding to a difference between diameters of a locking pin 74 and a pin hole 76, which will be described. As a result of this further rightward movement of the carriage 38, a right side surface 71A of the lever 71 of the first frame 56 comes into abutment onto the right wall 68 of the second frame 57, as indicated in FIG. 5B. In the present embodiment, the right wall 68 has an upper end portion which protrudes in the leftward direction toward the left wall 69, so that the right side face of the carriage 38 comes into abutment onto the protruding upper end portion of the right wall 68. As described above, the carriage 38 is slidably movable in the transverse direction 9 between the right wall 68 and the left wall 69.

Figure 9B:
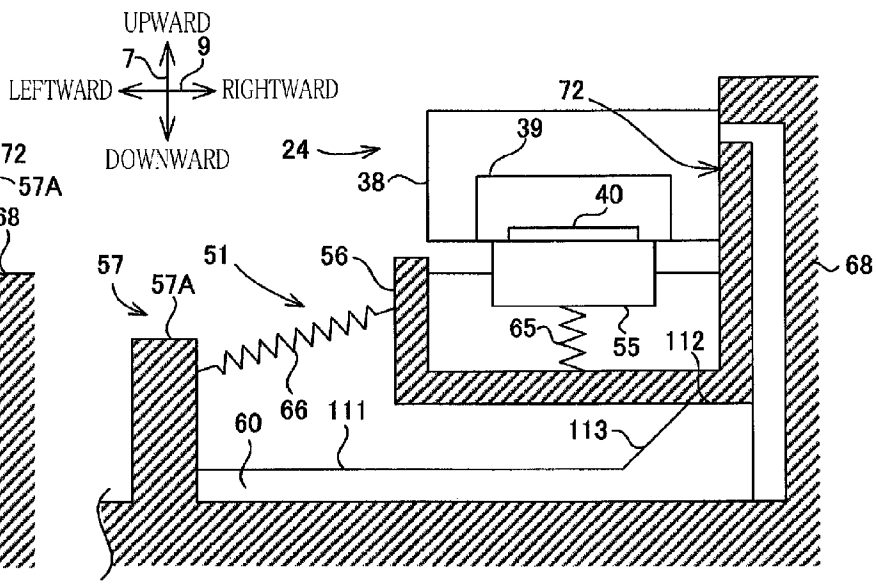
FIGS. 9A and 9B are side elevational views schematically showing the maintenance mechanism 51 where only a first frame 56 abuts on a right wall 68, and where only the carriage 38 abuts on the right wall 68, respectively.
Figure 9A:
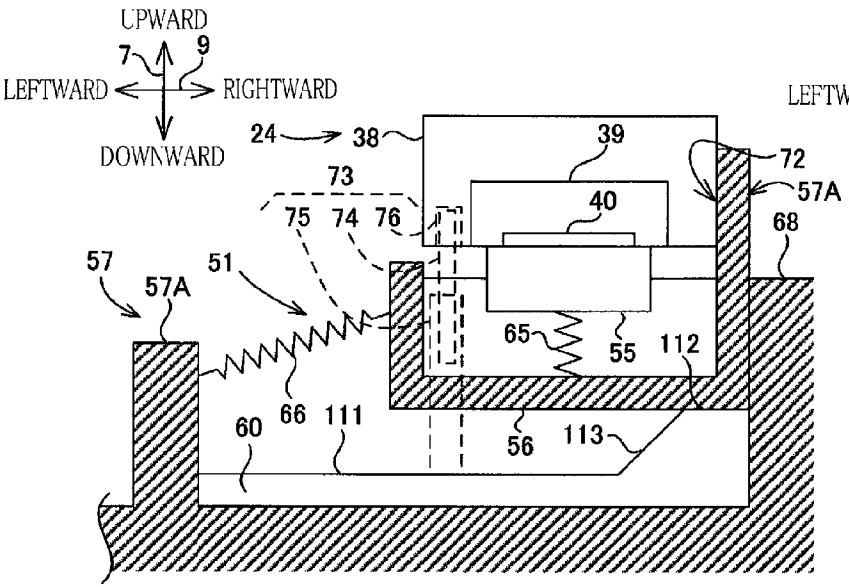

In the present embodiment, both of the carriage 38 and the first frame 56 come into abutment onto the right wall 68 when the cap 55 is placed into the first position. However, only the first frame 56 may come into abutment onto the right wall 68, as shown in FIG. 9A, or only the carriage 38 may come into abutment onto the right wall 68, as shown in FIG. 9B. In this connection, it is to be understood that an abutting contact of the carriage 38 with the first stationary member is interpreted to include an indirect abutting contact of the carriage 38 with the first stationary member (in the form of the right wall 68) via the first frame 56 or any other member, as well as a direct abutting contact of the carriage 38 with the first stationary member (including a direct abutting contact of both of the carriage 38 and the first frame 56 with the first stationary member).

<Locking Mechanism 73>

As shown in FIGS. 5A and 5B, the second frame 57 is provided with a locking pin 74. Described in detail, the second frame 57 has a locking-pin support portion 75 in its bottom wall, for supporting the locking pin 74 vertically movably. In FIGS. 5A and 5B, the locking pin 74 and the locking-pin support portion 75 are indicated by broken lines, since the positions of the locking pin 74 and locking-pin support portion 75 in the sheet feeding direction 8 are different from the position of the maintenance mechanism 51.

In the present embodiment, the locking pin 74 is movable in the vertical direction 7, with a drive force transmitted from a sheet feeding motor (not shown) provided to rotate the feed roller pair 89 and ejector roller pair 92 described above. That is, when the drive force is transmitted to the locking pin 74 in a forward direction, the locking pin 74 is moved upwards from a retracted position of FIG. 5A (an unlocking state) in which the locking pin 74 is accommodated in the locking-pin support portion 75, to a projecting position of FIG. 5B (a locking state) in which the locking pin 74 partially projects from the locking-pin support portion 75. When the drive force is transmitted to the locking pin 74 in a reverse direction opposite to the forward direction, the locking pin 74 is moved downwards from the projecting position to the retracted position. It is noted that the locking pin 74 may be vertically moved by a drive power source other than the sheet feeding motor, for example, by an electric motor exclusively provided to vertically move the locking pin 74.

The carriage 38 has a pin hole 76 open in its lower surface. The pin hole 76 is located such that the pin hole 76 is in opposition to the locking pin 74 and the locking-pin support portion 75, when the nozzles 40 are covered by the cap 55 placed in the first position of FIG. 5B as a result of the movement of the carriage 38 toward the right wall 68.

When the cap 55 is placed in the first position at which the cap 55 covers the nozzles 40 of the recording heads 39, the forward drive force is transmitted from the sheet feeding motor to the locking pin 74, so that the locking pin 74 is moved upwards from the retracted position to the projecting position, and is consequently partially inserted into the pin hole 76. As a result, the carriage 38 is locked in the transverse direction 9. When the reverse drive force is transmitted from the sheet feeding motor to the locking pin 74 while the carriage 38 is locked, so that the locking pin 74 is moved downwards from the projecting position to the retracted position, and is consequently removed from the pin hole 76. As a result, the carriage 38 is unlocked in the transverse direction 9.

It will be understood from the foregoing description that the locking pin 74, locking-pin support portion 75 and pin hole 76 cooperate with each other to constitute a locking mechanism 73 which is operable between the above-indicated locking and unlocking states for respectively inhibiting and permitting the movement of the carriage 38. However, the arrangement of the locking mechanism 73 is not limited to that described above, as long as the locking mechanism is arranged to lock the carriage 38 in the transverse direction 9.

<Control Device>

The multi-function apparatus 1 has a control device, which is provided by a microcomputer on a printed-circuit board, or various kinds of electronic components. The control device has a memory portion including a RAM and a ROM, and is configured to detect the position of the carriage 38 on the basis of the output signal of the optical sensor 35. On the basis of the detected position of the carriage 38, the control device controls the carriage drive motor 96, a sheet supply motor provided to rotate the sheet supply roller 25, and the above-described sheet feeding motor. The control device executes a control routine illustrated in the flow chart of FIG. 6, to set a point of origin of the carriage 38 according to the principle of this invention, as described below in detail.

<Setting of Point of Origin of Carriage 38>

Upon power application to the multi-function apparatus 1, the control device operates to set the point of origin of the carriage 38. The operations to set the point of origin of the carriage 38 will be described by reference to FIGS. 6-8.

Figure 7A:
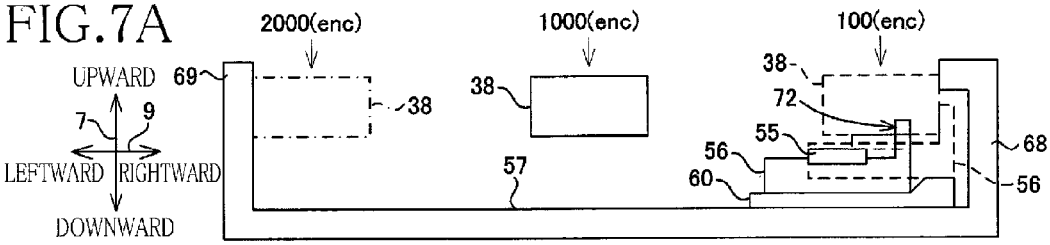
FIGS. 7A-7F are side elevational views schematically showing the maintenance mechanism 51, to explain a first processing operation.
Figure 7B:
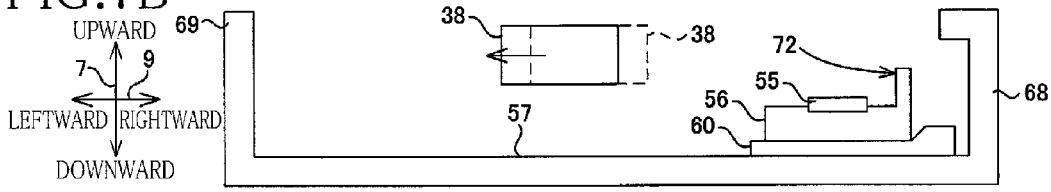
Figure 8A:
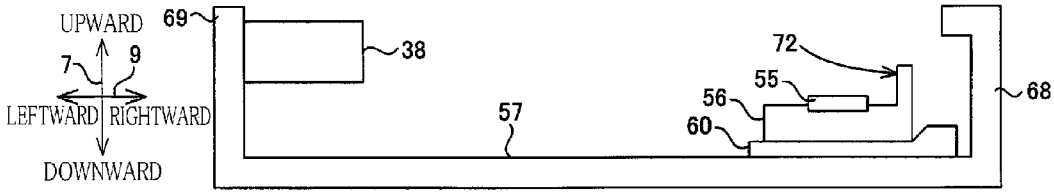
FIGS. 8A-8C are side elevational views schematically showing the maintenance mechanism 51, to explain second and third processing operations.
Figure 8B:
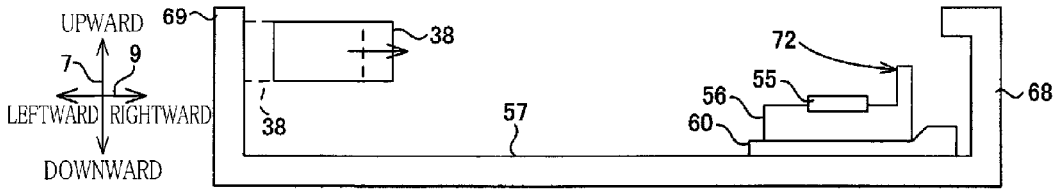
Figure 8C:
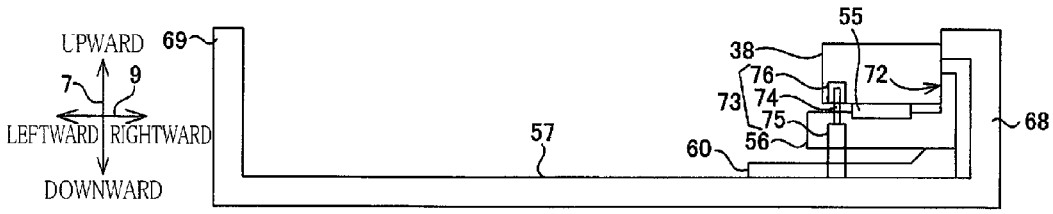

The control device performs the different processing operations depending upon the position of the carriage 38 in the transverse direction 9 upon the power application to the multi-function apparatus 1. Namely, the first processing operation is performed when the carriage 38 is stopped at a position other than the right and left ends of a range of movement of the carriage 38 (between the right and left walls 68, 69), for instance, at a position in a generally central part of the range of movement, as in the case of FIG. 7A, when the multi-function apparatus 1 is turned on. The second processing operation is performed when the carriage 38 is stopped at the left end of the range of movement, as indicated in FIG. 8A, while the third processing operation is performed when the carriage 38 is stopped at the right end of the range of movement, as indicated in FIG. 8C.

In the following description, the position and the distance of movement of the carriage 38 are expressed by a unit called an encoder pitch "enc" which is the predetermined spacing pitch of the detector pattern of the encoder strip 50. The position of the carriage 38 at the right end of the range of movement is represented by 100 (enc), while the position of the carriage 38 at the left end of the range of movement is represented by 2000 (enc), as indicated in FIG. 7A. Therefore, the range of movement of the carriage 38 is represented by 1900 (enc)=2000 (enc)−100 (enc).

<First Processing Operation>

Figure 6:
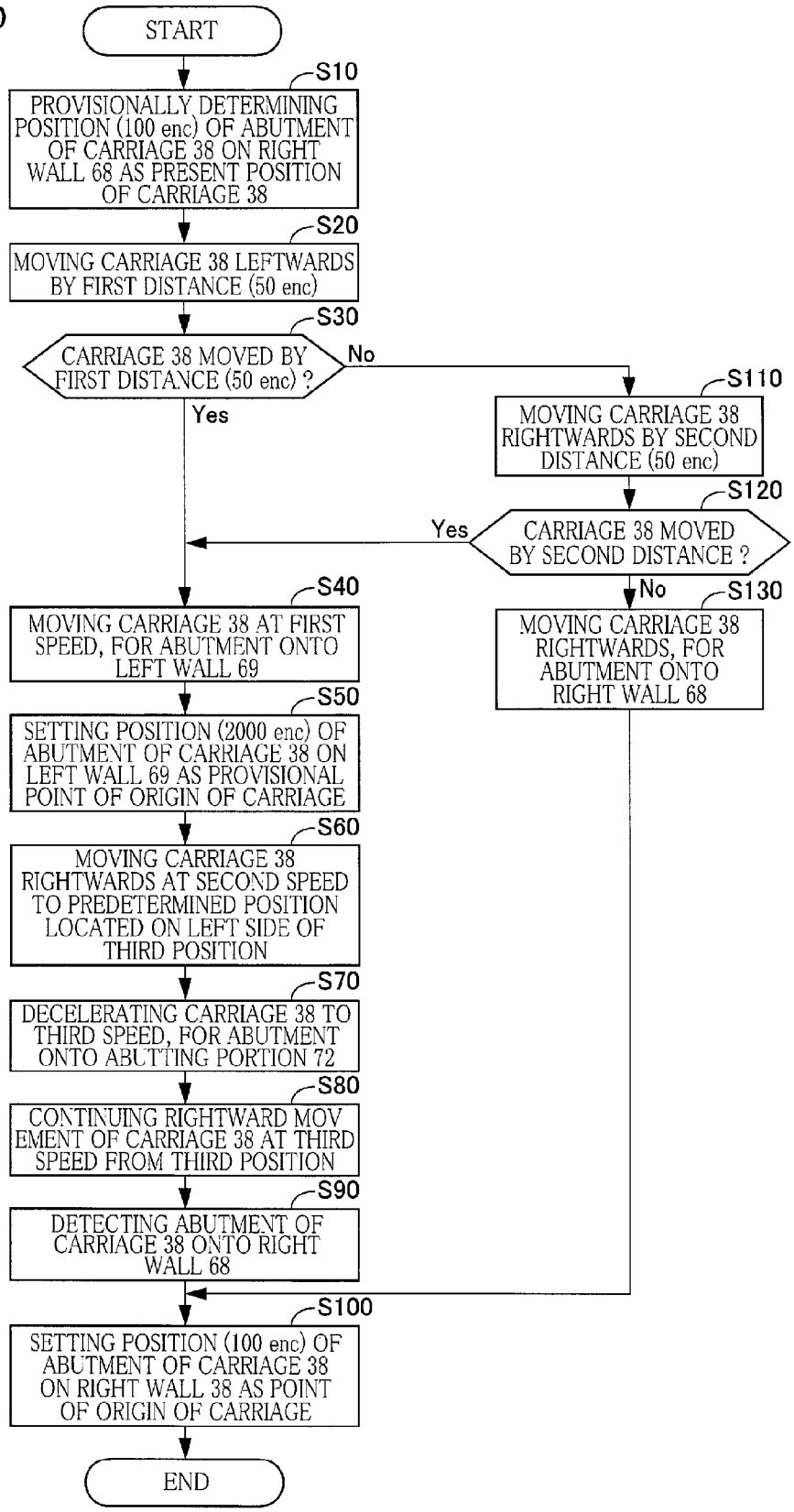
FIG. 6 is a flow chart illustrating a control routine executed to set a point of origin of a carriage 38 of the printer portion 2.

Upon power application to the multi-function apparatus 1, the control routine of FIG. 6 is initiated with step S10 to provisionally determine the position (100 enc) of abutment of the carriage 38 on the right wall 68, as the present position of the carriage 38. Although the carriage 38 is presently stopped at a position (1000 enc) between the right and left ends of the range of movement, as indicated by solid line in FIG. 7A, the control device which is not capable of detecting this position upon the power application provisionally determines that the carriage 38 is presently located at the position (100 enc) of abutment of the carriage 38 on the right wall 68 indicated by broken line in FIG. 7A.

The control flow then goes to step S20 to control the carriage drive motor 96 for moving the carriage 38 in the leftward direction by a predetermined first distance, for instance, by a distance of 50 (enc). A part of the control device assigned to implement the step S20 corresponds to a third control portion. Then, step S30 is implemented to determine whether the carriage 38 has been moved by the predetermined first distance. In the present example of the first processing operation wherein the carriage 38 is stopped at an almost central area of the range of movement, the carriage 38 is moved by the first distance from the position indicated by broken line in FIG. 5B to a position indicated by solid line in the same figure.

If an affirmative determination (Yes) is obtained in the step S30, the control flow goes to step S40 to control the carriage drive motor 96 for further moving the carriage 38 in the leftward direction at a first speed by a distance of 2000 (enc). A part of the control device assigned to implement the step S40 corresponds to a first control portion. This first control portion is operated if the carriage 38 has been moved by the predetermined first distance under the control of the above-indicated third control portion.

The distance of 2000 (enc) described above with respect to the step S40 is determined as a distance of movement in the leftward direction sufficient for the carriage 38 to come into abutment onto the left wall 69. The distance of leftward movement of the carriage 38 to be effected in the step S40 is not limited to 2000 (enc), but may be suitably determined otherwise, for instance, to be 3000 (enc) or 1900 (enc), provided the determined distance is sufficient for abutment of the carriage 38 onto the left wall 69 during its leftward movement.

In the present embodiment, the first speed is determined to be a maximum speed value at which the carriage 38 can be moved. This maximum speed value is determined by the capacities of the carriage drive motor 96 and the belt-type transmission mechanism 46 of the multi-function apparatus 1. While the first speed is preferably the maximum speed value of the carriage 38, but may be lower than the maximum speed value.

Figure 7C:
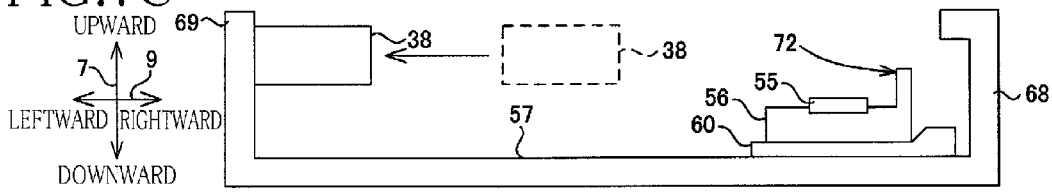

In the present example of the first processing operation wherein the above-indicated first distance is 50 (enc), the carriage 38 is located at the position of 1050 (enc) indicated by broken line in FIG. 7C, immediately before implementation of the step S40. Accordingly, the carriage 38 comes into abutment onto the left wall 69 when the carriage 38 has been moved by a distance of 950 (enc) in the step S40, as indicated by broken line in FIG. 7C. Thereafter, the carriage 38 is held in abutting contact with the left wall 69, even in the presence of a command for a continued leftward movement of the carriage 38. Namely, the output signal of the optical sensor 35 alternately changes between high and low levels (alternately rises and falls) during the leftward movement of the carriage 38, but is held at the high or low level after the carriage 38 has come into abutting contact with the left wall 69. The control device detects that the level of the output signal is held unchanged, and thereby recognizes that the carriage 38 is stopped in abutting contact with the left wall 69. The control flow then goes to step S50 to set the position (2000 enc) of abutment of the carriage 38 on the left wall 69 as a provisional point of origin of the carriage 38. A part of the control device assigned to implement the step S50 corresponds to a first setting portion.

Figure 7D:
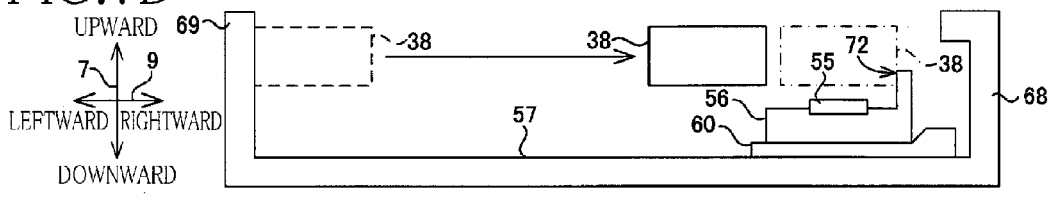

The control flow then goes to step S60 to control the carriage drive motor 69 for moving the carriage 38 in the rightward direction at a second speed from the position of 2000 (enc) indicated in broken line in FIG. 7D, to a predetermined position indicated by solid line in the same figure.

In the present embodiment, the above-indicated second speed is determined to be the maximum speed value of the carriage 38, like the above-indicated first speed, but may be lower than the maximum speed value. Obviously, the second speed may be different from the first speed.

The predetermined position described above with respect to the step S60 is spaced leftwards by a predetermined distance from a third position at which the carriage 38 abuts on the right wall 68. This predetermined distance is determined to be sufficient for permitting the carriage 38 to be decelerated from the second speed to a third speed lower than the second speed. Namely, the distance in question decreases with a maximum deceleration value of the carriage 38. The third speed is determined to be low enough to prevent destruction of menisci formed at the nozzles 40 when the carriage 38 comes into abutment onto the abutment portion 72 of the first frame 56.

It is noted that the third position is determined by the position of the maintenance mechanism 51, while the provisional point of origin of the carriage 38 is determined by the position of the left wall 69, and that the distance from the provisional point of origin to the third position is determined by the provisional point of origin set in the step S50.

Figure 7E:
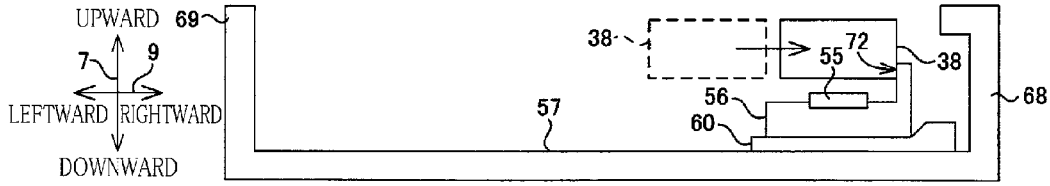
Figure 7F:
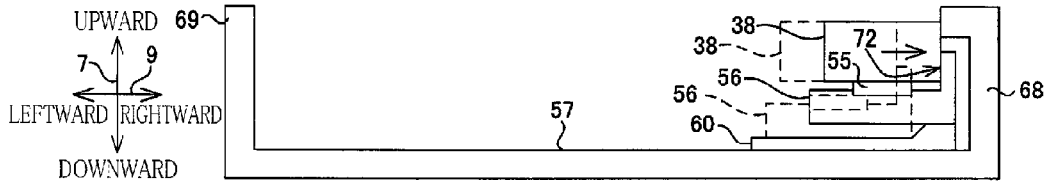

The control flow then goes to step S70 to initiate deceleration of the carriage 38 which has reached the above-described predetermined position indicated by broken line in FIG. 7E, so that the carriage 38 is decelerated down to the third speed before the carriage 38 reaches the above-indicated third position, that is, so that the carriage 38 comes into abutment onto the right wall 68, at the third speed at the third position, as indicated by solid line in FIG. 7E. Namely, the carriage 38 is moved at the second speed between the provisional point of origin and the above-indicated predetermined position, and is brought into abutment onto the right wall 68 at the third speed.

In the present embodiment, the deceleration of the carriage 38 from the second speed to the third speed is carried out under the control of the control device, in the following manner. That is, when the carriage 38 has been moved to the above-indicated predetermined position at the second speed, the deceleration of the carriage 38 is initiated, and the carriage 38 is once stopped. Then, the carriage 38 is moved again with acceleration up to the third speed before the carriage 38 reaches the third position. However, the manner of deceleration of the carriage 38 from the second speed to the third speed is not limited to that described above. For instance, the carriage 38 may be decelerated from the second speed to the third speed, without a temporary stop between the above-indicated predetermined position and the third position.

Then, the control flow goes to step S80 to control the carriage drive motor 69 for continuing the rightward movement of the carriage 38 at the third speed from the third position. As a result, the carriage 38 which has come into in abutment onto the abutment portion 72 at the third position (indicated by broken line in FIG. 7F) comes into abutment onto the right wall 68, as indicated by solid line in FIG. 7F, while being held in abutting contact with the abutment portion 72. In other words, the carriage 38 is moved at the third speed rightward from the third position while pushing the first frame 56 at its abutment portion 72, and is eventually brought into abutting contact with the right wall 68, at a position located on the right side of the third position.

As a result of the rightward movement of the first frame 56 with its abutment portion 72 held in abutting contact with the carriage 38, the cap 55 is moved upwards from the second position to the first position, to cover the nozzles 40, as shown in FIG. 5B.

During the rightward movement of the carriage 38 from the third position toward the right wall 68, the output signal of the optical sensor 35 alternately changes between high and low levels (alternately rises and falls) during the right movement of the carriage 38 until the carriage 38 comes into abutting contact with the right wall 68, and but is held at the high or low level after the carriage 38 has come into the abutting contact with the right wall 68, as in the case of the leftward movement for abutment onto the left wall 69 described above with respect to the step S50. The control device detects in step S90 that the level of the output signal is held unchanged, and thereby recognizes that the carriage 38 is stopped in abutting contact with the right wall 68. A part of the control device assigned to implement the steps S60-S90 corresponds to a second control portion. Then, the control flow goes to step S100 to set the position (100 enc) of the carriage 38 in abutting contact with the right wall 68 (position detected in step S90) as a point of origin of the carriage 38. A part of the control device assigned to implement the step S100 corresponds to a second setting portion.

<Second Processing Operation>

The second processing operation is performed when the carriage 38 is stopped at the left end of the range of movement of the carriage 38 indicated in FIG. 8A, upon power application to the multi-function apparatus 1. Since the carriage 38 is held in abutting contact with the left wall 69, the leftward movement of the carriage 38 by the first distance is prevented even if the carriage drive motor 96 is commanded to effect the leftward movement of the carriage 38. Accordingly, a negative determination (No) is obtained in the step S30 described above.

The control flow therefore goes to step S110 to control the carriage drive motor 96 for moving the carriage 38 in the rightward direction by a predetermined second distance, for instance, by a distance of 50 (enc). A part of the control device assigned to implement the step S110 corresponds to a fifth control portion. Then, step S120 is implemented to determine whether the carriage 38 has been moved rightwards by the predetermined second distance. In the present example of the second processing operation wherein the carriage 38 is stopped at the left end of the range of movement, the carriage 38 is moved by the second distance from the position indicated by broken line in FIG. 8B to a position indicated by solid line in the same figure.

When an affirmative determination (Yes) is obtained in the step S120, that is, when the carriage 38 has been moved rightwards by the second distance, the control flow goes to the above-described steps S40-S100 corresponding to the first control portion, first setting portion, second control portion and second setting portion. In the step S40 implemented in the first processing operation, the carriage drive motor 96 is commanded to move the carriage 38 leftwards by the distance of 2000 (enc) sufficient for abutment of the carriage 38 onto the left wall 69. In the present second processing operation, however, the distance of the leftward movement commanded in the step S40 for abutment of the carriage 38 onto the left wall 69 may be shorter than 2000 (enc), since the carriage 38 after implementation of the step S110 is stopped at a position which is nearer to the left wall 69 than the position from which the carriage 38 is moved in the step S40 for abutment onto the left wall 69 in the first processing operation.

<Third Processing Operation>

The third processing operation is performed when the carriage 38 is stopped at right end of the range of movement of the carriage 38 indicated in FIG. 8C, upon power application to the multi-function apparatus 1. If the locking pin 74 is placed in its projecting position, the carriage 38 stopped at the right end cannot be moved by a distance larger than a distance d1 (indicated in FIG. 5B) corresponding to the above-indicated difference between the diameters of the locking pin 74 and the pin hole 76. This distance d1 is smaller than the first distance of 50 (enc). In the present example of the third processing operation, the locking pin 74 is placed in the projecting position. In FIGS. 7 and 8, the locking mechanism 73 is not shown, except in FIG. 8C.

In the third processing operation wherein the carriage 38 is locked by the locking pin 74 as shown in FIG. 8C, upon power application to the multi-function apparatus 1, the carriage 38 cannot be moved by the first distance as described above. Accordingly, the negative determination (No) that the carriage 38 has not been moved leftwards by the first distance is obtained in the step S30, and a negative determination (No) that the carriage 38 has not been moved rightwards by the second distance is obtained in the step S120.

Accordingly, the control flow goes to step S130 to control the carriage drive motor 96 for moving the carriage 38 in the rightward direction by a distance sufficient for abutment of the carriage 38 onto the right wall 68. A part of the control device assigned to implement the step S130 corresponds to a sixth control portion. As a result, the carriage 38 is moved rightwards by only the above-indicated distance d1, and comes into abutment onto the right wall 68. In the present example of the third processing operation wherein the rightward movement of the carriage 38 by the above-indicated distance d1 results in the abutting contact of the carriage 38 with the right wall 68, the carriage drive motor 96 is commanded in the step S130 to move the carriage 38 rightwards by a comparatively small distance for abutment of the carriage 38 onto the right wall 68.

The step S130 is followed by the step S100. In the third processing operation, the position of abutment of the carriage 38 on the right wall 68 which is detected by the linear encoder 52 in the step S130 corresponding to the sixth control portion is set as the point of origin of the carriage 38, in the step S100 corresponding to the second setting portion.

Advantages of the Embodiment

The present embodiment is configured such that the carriage 38 is moved toward the left wall 69 remote from the cap 55, under the control of the first control portion, and the position of abutment of the carriage 38 on the left wall 59 is set by the first setting portion as the provisional point of origin of the carriage. The carriage 38 is moved, under the control of the second control portion, at the comparatively high second speed at least to a position slightly before the third position which is determined by the provisional point of origin and at which the carriage 38 comes into abutment onto the abutment portion 72. This rightward movement of the carriage from the provisional point of origin at the second speed under the control of the second control portion may be a movement of the carriage at the second speed by an entire distance from the provisional point of origin to the third position, or a movement of the carriage at the second speed by a portion of the above-indicated distance, which portion is between the provisional point of origin and the position which is slightly before the third position and at which the carriage is decelerated. This rightward movement of the carriage at the comparatively high speed minimizes a time required for setting the point of origin of the carriage.

The deceleration of the carriage 38 to the comparatively low third speed is initiated at the position slightly before the third position, under the control of the second control portion, so that the carriage 38 comes into abutment onto the abutment portion 72 at the third speed at the third position. Accordingly, it is possible to reduce a force which acts upwardly on the nozzles 40 through the abutment portion 72 when the cap 55 is moved from the first position to the second position. The comparatively high second speed may be equal to or different from the first speed. Thus, the present embodiment is configured to prevent destruction of the menisci formed at the nozzles 40, while minimizing the time required for setting the point of origin of the carriage 38.

In the present embodiment, the carriage 38 cannot be moved in the leftward direction even when the carriage drive motor 96 is controlled to move the carriage 38 in the leftward direction, if the carriage 38 is held in abutment on the left wall 69 upon initiation of setting of the point of origin of the carriage 38. Namely, the third control portion is not able to determine whether the leftward movement of the carriage 38 is inhibited by the locking of the carriage 38 by the locking mechanism 73 or by abutment of the carriage 38 on the left wall 69.

In view of the fact described above, the present embodiment is configured such that the fifth control portion initially controls the carriage drive motor 96 for moving the carriage 38 in the right direction by the second distance, to determine whether the carriage 38 is held in abutment on the left wall 69, depending upon whether the carriage 38 has been moved in the rightward direction under the control of the fifth control portion. Depending upon a result of the determination as to whether the carriage 38 is held in abutment on the left wall 69, the carriage drive motor is controlled for moving the carriage 38 in the leftward or rightward direction, and for setting the provisional point of origin or the point of origin of the carriage 38. The present embodiment permits the setting of the point of origin of the carriage 38 even if the carriage 38 is held in abutment on the let wall 69 upon power application of the multi-function apparatus 1.

The present embodiment is further configured such that at least one of the first and second speeds is determined to be the maximum speed value of the carriage 38, for minimizing the time required for setting the point of origin of the carriage 38.

The present embodiment is also configured such that the second control portion controls the carriage drive motor 96 so as to once stop the carriage 38 which has been moved at the second speed in the rightward direction, and to then move the carriage 38 at the third speed. In this case, the carriage 38 can be moved accurately at the different speeds by the carriage drive motor 96, even where the carriage drive motor 96 is a relatively inexpensive motor the operating speed of which cannot be intricately controlled continuously to the different speeds.

<First Modification>

The steps S110 and S120 in the control routine of the flow chart of FIG. 6 may be eliminated. In this case, the control flow goes to the step S130 to control the carriage drive motor 96 for moving the carriage 38 in the rightward direction by the distance sufficient for abutment of the carriage 38 onto the right wall 68, when the negative determination (No) that the carriage 38 has not been moved in the leftward direction by the first distance is obtained in the step S30. In this first modification, the part of the control device assigned to implement the step S130 corresponds to a fourth control portion.

In the first modification, too, the step S130 is followed by the step S100. Namely, the position of abutment of the carriage 38 on the right wall 68 which is detected by the linear encoder 52 in the step S130 corresponding to the sixth control portion is set as the point of origin of the carriage 38, in the step S100 corresponding to the second setting portion.

When the carriage 38 is locked by the locking mechanism 73, the carriage 38 cannot be moved rightwards under the control of the first control portion. In the first modification, the determination as to whether the carriage 38 is locked by the locking mechanism 73 is made by determining whether the carriage 38 has been moved leftwards by the first distance under the control of the third control portion (S20). Depending upon the affirmative or negative determination obtained in the step S30, the carriage 38 is moved leftwards or rightwards, and the provisional point of origin and the point of origin of the carriage 38 are set. The first modification permits the setting of the point of origin of the carriage 38 even where the printer portion 2 of the multi-function apparatus 1 is constructed to lock the carriage 38 by the locking mechanism 73.

<Second Modification>

In the illustrated embodiment, the slide cam 60 is used to permit the cap 55 to be movable between the first and second positions. However, any suitable means other than the slide cam 60 may be used to permit a movement of the cap 55 between the first and second positions.

Figure 10A:
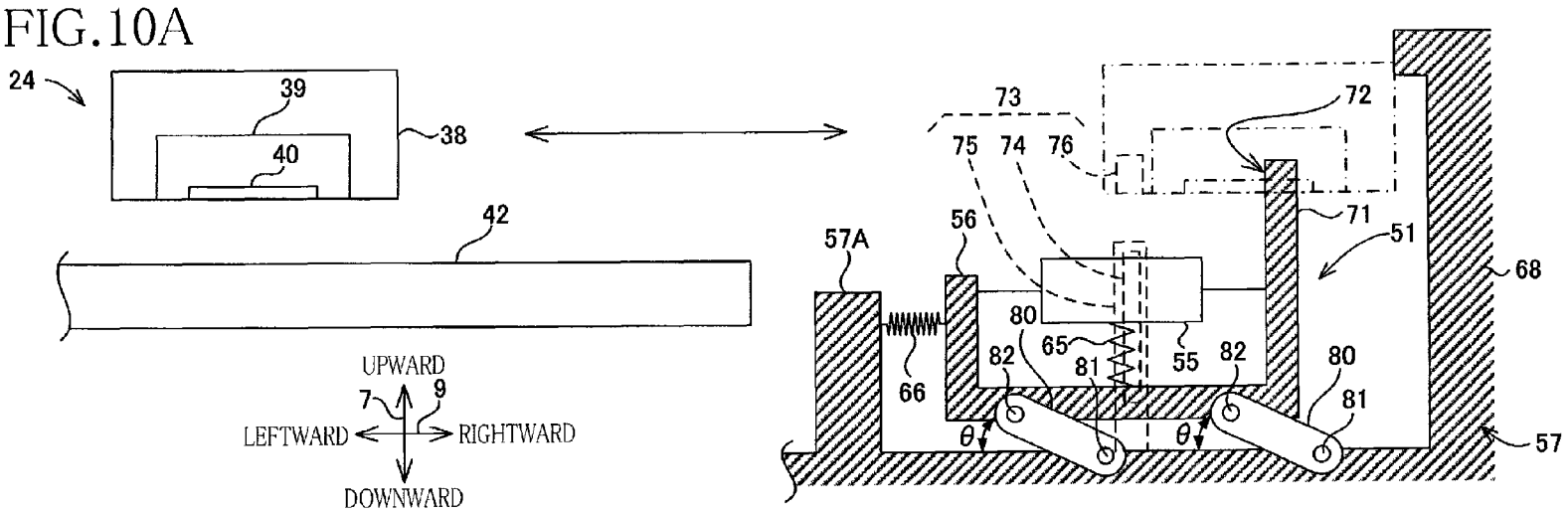
FIGS. 10A and 10B are side elevational views schematically showing the maintenance mechanism 51 in a second modification of the embodiment, when the cap 55 is placed in the second and first positions, respectively.
Figure 10B:
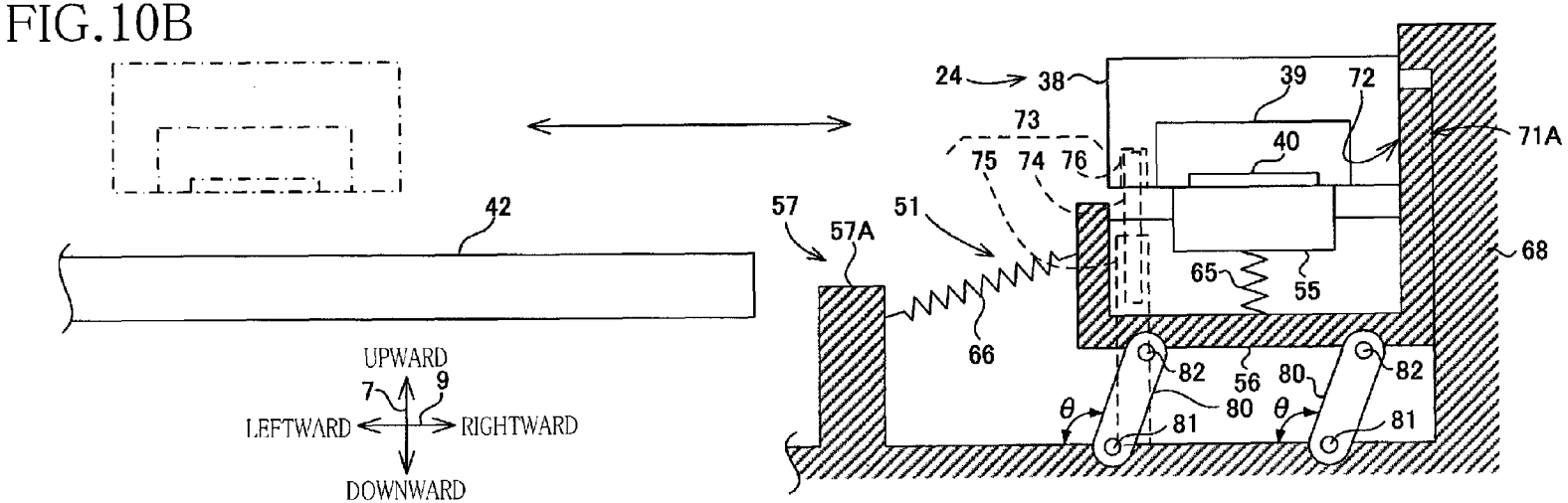

For instance, the first frame 56 may be connected to the second frame 57 through four linking arms 80, as shown in FIGS. 10A and 10B (wherein only the two linking arms 80 are shown). Each of the linking arms 80 has two pins 81, 82 at its opposite ends. Each linking arm 80 is pivotably connected at its pins 80, 81 to the first and second frames 56, 57, respectively. The linking arms 80 permit the first frame 56 and the cap 55 to be vertically movable between the second position at which the first frame 56 is located relatively near the bottom wall of the second frame 57 and an angle θ between the centerlines passing the axes of the pins 80, 81 and the bottom wall of the second frame 57 is the smallest, and the first position at which the first frame 56 is located relatively distant from the bottom wall of the second frame 57 and the angle θ is the largest.

<Third Modification>

In the illustrated embodiment, the control device is configured to control the carriage drive motor 96 for moving the carriage 38 rightwards at the third speed from the third position, so that the carriage 38 comes into abutment onto the right wall 68. However, the control portion may be modified to control the carriage drive motor 96 for moving the carriage 38 rightwards at the third speed from the third position, until the cap 55 has been moved from the second position to the first position, and for further moving the carriage 38 rightwards at a fourth speed after the cap 55 has been moved to the first position, so that the carriage 38 comes into abutment onto the right wall 68 at the fourth speed. The fourth speed is determined to be higher than the third speed, for example, to be almost equal to the first or second speed.

In the third modification of the illustrated embodiment wherein the maintenance mechanism 51 is constructed as shown in FIGS. 5A and 5B, the control device controls the carriage drive motor 96 for moving the carriage 38 at the third speed while the first frame 56 is slidably moved on the slant surface 113, and at the fourth speed while the first frame 56 is slidably moved on the second guide surface 112. Described in detail, the control device controls the carriage drive motor 96 such that the acceleration of the carriage 38 from the third speed to the fourth speed is initiated a short time before or at the time when the first frame 56 which has been moved on the slant surface 113 begins to be moved on the third guide surface 112, or at the time.

After the cap 55 has been moved from the second position to the first position, the carriage 38 does not receive an upwardly acting force from the first frame 56 and the cap 55, so that there is not a risk of destruction of the menisci formed at the nozzles 40 of the recording heads 39. In view of this fact, the control device according to the third modification controls the carriage drive motor 96 to move the carriage 38 at the comparatively high fourth speed, while there is not the risk of destruction of the menisci. Thus, the third modification minimizes the length of time required for setting the point of origin of the carriage 38.

In the illustrated embodiment and the third modification, the control device controls the carriage drive motor 96 for moving the carriage 38 rightwards from the third position at the third speed or the fourth speed higher than the third speed. However, the control device may be configured to control the carriage drive motor 96 for moving the carriage 38 rightwards from the third position at a speed lower than the third speed.

In the illustrated embodiment, the locking mechanism 73 permits the carriage 38 to be moved rightwards by only the distance d1 for abutment of the carriage 38 onto the right way 68, when the locking pin 74 is placed in its projecting position. However, the locking mechanism 73 may be modified to inhibit the leftward movement of the carriage 38 and permit the rightward movement of the carriage 38 by a distance larger than the distance d1, for abutment of the carriage 38 onto the right wall 68. Namely, the locking mechanism 73 may be modified such that the engagement of the locking pin with the pin hole 76 inhibits the leftward movement of the carriage 38 and permits the rightward movement of the carriage 38.

What is claimed is:

1. An ink-jet recording apparatus comprising:

a recording head having nozzles through which droplets of an ink are ejected;

a drive power source;

a carriage on which the recording head is mounted and which is slidably movable by the drive power source in opposite first and second directions;

a first stationary member onto which the carriage is abuttable during its movement in the first direction;

a second stationary member onto which the carriage is abuttable during its movement in the second direction;

a detecting portion configured to detect a position of the carriage;

a cap which is disposed nearer to the first stationary member than to the second stationary member and which is movable between a first position at which the cap is held in abutting contact with the recording head and covers the nozzles, and a second position at which the cap is spaced apart from the recording head;

a displacing mechanism having an abutment portion onto which the carriage is abuttable in the first direction, and configured to move the cap from the second position to the first position by a pushing force generated when the abutment portion comes into abutting contact with the carriage;

a first control portion configured to control the drive power source for moving the carriage in the second direction at a first speed by a distance sufficient for abutment of the carriage onto the second stationary member;

a first setting portion configured to set a position of abutment of the carriage on the second stationary member as a provisional point of origin of the carriage, when the position of abutment of the carriage on the second stationary member is detected by the detecting portion;

a second control portion configured to control the drive power source for moving the carriage which has been moved under the control of the first control portion, in the first direction at a second speed by at least a portion of a distance between the provisional point of origin and a third position which is determined by the provisional point of origin and at which the carriage comes into abutment onto the abutment portion, and for further moving the carriage in the first direction at a third speed lower than the second speed, so that the carriage comes into abutment onto the abutment portion at the third speed at the third position, the second control portion being further configured to control the drive power source for further moving the carriage from the third position in the first direction for abutment of the carriage onto the first stationary member; and a second setting portion configured to set a position of abutment of the carriage on the first stationary member as a point of origin of the carriage when the position of abutment of the carriage on the first stationary member is detected by the detecting portion as a result of the movement of the carriage in the first direction under the control of the second control portion.

2. The ink-jet recording apparatus according to claim 1, wherein the second control portion is configured to control the drive power source for moving the carriage from the third position in the first direction at the third speed, for abutment of the carriage onto the first stationary member at the third speed.

3. The ink-jet recording apparatus according to claim 1, further comprising:

a third control portion configured to control the drive power source for moving the carriage in the second direction by a first distance; and a fourth control portion configured to control the drive power source for moving the carriage in the first direction by a distance sufficient for abutment of the carriage onto the first stationary member, if the carriage has not been moved in the second direction by the first distance under the control of the third control portion, and wherein the first control portion controls the drive power source for moving the carriage in the second direction at the first speed by the distance sufficient for abutment of the carriage onto the second stationary member, if the carriage has been moved in the second direction by the first distance under the control of the third control portion, and the second setting portion sets the position of abutment of the carriage on the first stationary member as the point of origin of the carriage when the position of abutment of the carriage on the first stationary member is detected by the detecting portion as a result of the movement of the carriage in the first direction under the control of the fourth control portion.

4. The ink-jet recording apparatus according to claim 3, further comprising a locking mechanism operable between a locking state in which the locking mechanism inhibits a movement of the carriage in at least the second direction while the cap is placed in the first position, and an unlocking state in which the locking mechanism does not inhibit the movement of the carriage, and wherein the locking mechanism is configured to permit abutment of the carriage onto the first stationary member when the drive power source is controlled to move the carriage in the first direction under the control of the fourth control portion.

5. The ink-jet recording apparatus according to claim 1, further comprising;

a third control portion configured to control the drive power source for moving the carriage in the second direction by a first distance;

a fifth control portion configured to control the drive power source for moving the carriage in the first direction by a second distance, if the carriage has not been moved in the second direction by the first distance under the control of the third control portion; and a sixth control portion configured to control the drive power source for moving the carriage in the first direction by a distance sufficient for abutment of the carriage onto the first stationary member, if the carriage has not been moved in the first direction by the second distance under the control of the fifth control portion, and wherein the first control portion controls the drive power source for moving the carriage in the second direction at the first speed by the distance sufficient for abutment of the carriage onto the second stationary member, if the carriage has been moved in the second direction by the first distance under the control of the third control portion, or if the carriage has been moved in the second direction by the second distance under the control of the fifth control portion, and the second setting portion sets the position of abutment of the carriage on the first stationary member as the point of origin of the carriage when the position of abutment of the carriage on the first stationary member is detected by the detecting portion as a result of the movement of the carriage in the first direction under the control of the sixth control portion.

6. The liquid ejecting apparatus according to claim 5, further comprising a locking mechanism operable between a locking state in which the locking mechanism inhibits a movement of the carriage in at least the second direction while the cap is placed in the first position, and an unlocking state in which the locking mechanism does not inhibit the movement of the carriage in the second direction, and wherein the locking mechanism is configured to permit abutment of the carriage onto the first stationary member when the drive power source is controlled to move the carriage in the first direction under the control of the sixth control portion.

7. The ink-jet recording apparatus according to claim 1, wherein at least one of the first speed and the second speed is a maximum speed value at which the carriage can be moved by the drive power source.

8. The ink-jet recording apparatus according to claim 1, wherein the second control portion controls the drive power source so as to once stop the carriage which has been moved at the second speed, and to then move the carriage at the third speed.

9. The ink-jet recording apparatus according to claim 1, wherein the second control portion is configured to control the drive power source for moving the carriage from the third position in the first direction for abutment of the carriage onto the first stationary member, at a fourth speed lower than the third speed, after the cap has been moved from the second position to the first position.

* * * * *